United States Patent [19]

Hutt

[11] 4,012,606

[45] Mar. 15, 1977

[54] PLURAL SWITCH SLIDING CAMS ACTUATED BY PREDETERMINED PROGRAM GROOVES ASSOCIATED WITH COMMON DRIVING MECHANISM

[75] Inventor: Philip Hutt, Milford, Conn.

[73] Assignee: General Electric Company, Fort Wayne, Ind.

[22] Filed: Apr. 7, 1975

[21] Appl. No.: 565,648

[52] U.S. Cl. ..... 200/18; 200/6 B; 200/153 L

[51] Int. Cl.[2] ..... H01H 3/42; H01H 21/84

[58] Field of Search ..... 74/567, 568; 200/1 R, 200/4, 5 R, 6 R, 6 B, 6 BB, 6 C, 9, 14, 16 R, 18, 61.86, 153 L, 153 LA, 153 LB

[56] References Cited

UNITED STATES PATENTS

| | | | |
|---|---|---|---|
| 2,569,487 | 10/1951 | Mitchell | 226/72 |
| 2,710,323 | 6/1955 | Andrews | 200/153 L |
| 2,761,041 | 8/1956 | Yarrick | 200/153 L |
| 3,196,223 | 7/1965 | Hartsock | 200/16 D |
| 3,198,893 | 8/1965 | Mapelsden | 200/6 B |
| 3,275,782 | 9/1966 | Hartsock | 200/252 |
| 3,283,089 | 11/1966 | Anderson et al. | 200/18 |
| 3,459,903 | 8/1969 | Richardson | 200/6 B |
| 3,592,982 | 7/1971 | Deltoer | 200/18 X |
| 3,637,961 | 1/1972 | Fiddler et al. | 200/61.86 |
| 3,663,770 | 5/1972 | Groskopfs | 200/18 X |

*Primary Examiner*—James R. Scott
*Attorney, Agent, or Firm*—Joseph E. Papin

[57] ABSTRACT

An electrical switch is provided with a casing having a plurality of means selectively operable for respectively completing a circuit through the casing. A pair of means are relatively movable generally linearly with respect to each other in the casing for controlling the operation of the circuit completing means, and means is rotatably mounted in the casing for driving the controlling means generally linearly relative to each other to effect the selective operation of the circuit completing means.

37 Claims, 11 Drawing Figures

PLURAL SWITCH SLIDING CAMS ACTUATED BY PREDETERMINED PROGRAM GROOVES ASSOCIATED WITH COMMON DRIVING MECHANISM

BACKGROUND OF THE INVENTION

This invention relates generally to electrical control devices and in particular to electrical switches and methods of operating an electrical switch.

In the past, various and sundry electrical switches have been provided for controlling or completing a plurality of circuits therethrough, and different modes of manually operating such electrical switches have been employed therewith. For instance, some of the more well known manual operating modes or actuating devices commonly employed with the prior art electrical switches were of the push button type, the toggle type, the slide type, and the rotary type including those with motion translating means, all of which are well known in the art.

With respect to at least some of the prior art rotary-type operated electrical switches, a cam having a predetermined cam configuration on one face thereof was rotated so that the cam configuration selectively operated a plurality of switch blades in following engagement therewith for respectively completing a circuit through the switch. At least one of the disadvantageous or undesirable features of this particular prior art rotary-type electrical switch is believed to be that the number of switch blades utilized dictated the size of the cam necessary to effect the selective operation thereof, i.e., the more switch blades utilized, the greater the size of the cam. Of course, an analogous disadvantageous or undesirable feature is believed to be that of the economics involved in providing larger cams to accommodate the greater number of switch blades.

In at least others of the prior art rotary-type operated electrical switches, a cam having a peripheral face with a plurality of cam configurations therein was rotated so that the cam configurations selectively operated a plurality of switch blades arranged adjacent the peripheral face of the cam in following engagement therewith for respectively completing a circuit through the switch. At least one of the disadvantageous or undesirable features of this particular prior art rotary-type electrical switch is believed to be that the space occupied by the various switch blades arranged adjacent the peripheral face of the cam for operation thereby appreciably limited the number of switch blades that could be employed in the switch.

Another similar prior art rotary-type operated electric switch contained a plurality of cams arranged generally in side-by-side relation, each having a peripheral face with a plurality of cam configurations therein, and a plurality of switch blades were arranged adjacent the peripheral face of each cam in following engagement therewith for respectively completing a circuit through the switch. In addition to the limited number of switch blades that could operably be employed peripherally about each cam, as previously mentioned, it is believed that at least another disadvantageous or undesirable feature of this particular prior art rotary-type electrical switch involved the consequential enlargement of the switch as additional cams were added in their side-by-side relation.

Further, in others of the prior art rotary-type electrical switches, a generally elongate stationary plate was provided with a plurality of contacts thereon, and another generally elongate scanner plate having a plurality of switch blades thereon was moved lengthwise and crosswise of the contact carrying plate to selectively engage the switch blades with the contacts for respectively completing circuits through the switch. A cam having a peripheral face defining a predetermined cam configuration was rotated to drivingly engage its peripheral face with a pair of follower posts on the scanner plate to impart the lengthwise and crosswise movement thereto. At least one of the disadvantageous or undesirable features of this particular prior art rotary-type electrical switch is believed to be that the driving engagement of the cam only with the scanner plate, at least in part, inhibited the motion translating capacity of device.

SUMMARY OF THE INVENTION

Among the several objects of the invention may be noted the provision of an electrical switch and a method of operating an electrical switch which overcome the disadvantageous or undesirable features discussed hereinabove, as well as others, with respect to the prior art electrical switches; the provision of such electrical switch and such method in which a pair of means for controlling the operation of the switch are relatively movable generally linearly with respect to each other in a predetermined programmed manner; the provision of such electrical switch and such method in which a rotary motion for initiating, actuating the switch is translated into the generally linear motion of the pair of controlling means; the provision of such electrical switch and such method in which a pair of means are relatively movable generally linearly with respect to each other for controlling the selective operation of a plurality of means for respectively completing a circuit through the switch; the provision of such electrical switch and such method in which means is rotatable for driving a pair of means generally linearly relative to each other to effect the selective operation of a plurality of means for respectively completing a circuit through the switch; and the provision of such electrical switch and such method in which the components thereof are simplistic in design, economically manufactured, and easily assembled. These, as well as other objects and advantageous features of the present invention will be in part apparent and in part pointed out hereinafter.

In general, an electrical switch is provided in one form of the invention with a casing having a plurality of means selectively operable for respectively completing a circuit through the casing. A pair of means are disposed generally in overlapping relation in the casing and movable with respect to each other in a predetermined program for controlling the operation of the circuit completing means, and means is rotatably mounted in the casing for driving each of the controlling means in the predetermined to each other so as to effect the selective operation of the circuit completing means.

Further in general, a method is provided in one form of the invention for operating an electrical switch having a casing with a plurality of means mounted therein and selectively operable for respectively completing a circuit through the switch. A pair of means is disposed in overlaying relation in the casing for controlling the selective operation of the circuit completing means. In this operating method, means is rotated in the casing for respectively driving each of the controlling means in a predetermined program with respect to each other, and the controlling means is moved in the casing through the predetermined program generally linearly with respect to each other in response to the rotating of the driving means so as to effect the selective operation of the circuit completing means.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention in any manner.

BRIEF DESCRIPTION OF THE PREFERRED EMBODIMENTS

Figure 1:
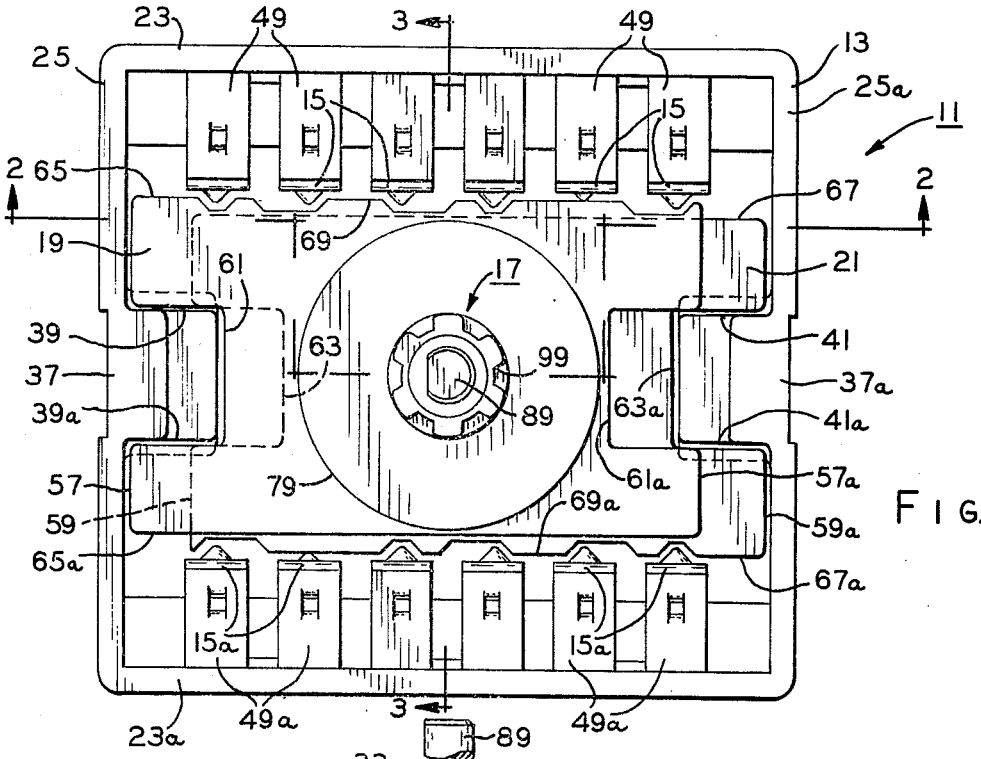
FIG. 1 is a plan view of an electrical switch in one form of the invention with the cover removed and illustrating principles of a method, respectively in one form of the invention, of operating an electrical switch.
Figure 2:
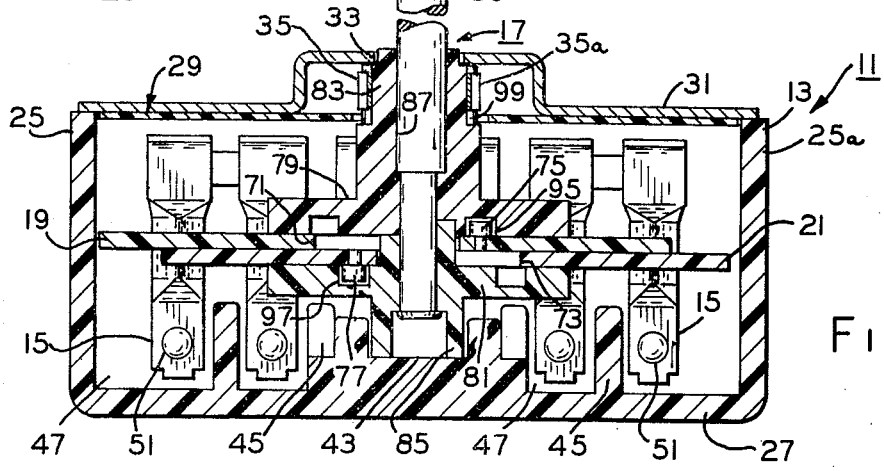
FIG. 2 is a sectional view generally along lines 2—2 of FIG. 1.
Figure 5:
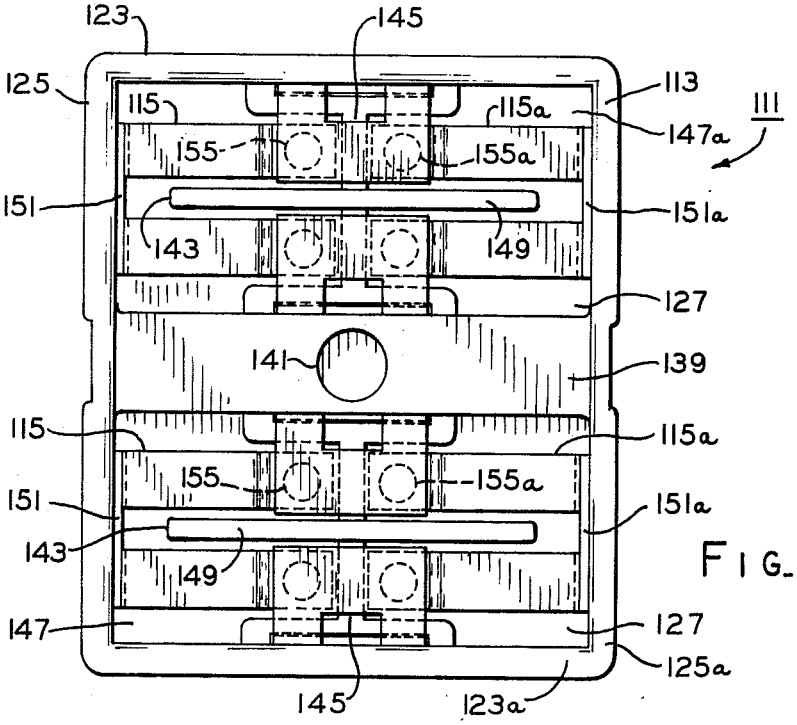
FIG. 5 is a plan view of a casing for an electrical switch in one form of the invention which illustrates principles of a method in one form of the invention of operating an electrical switch.
Figure 7:
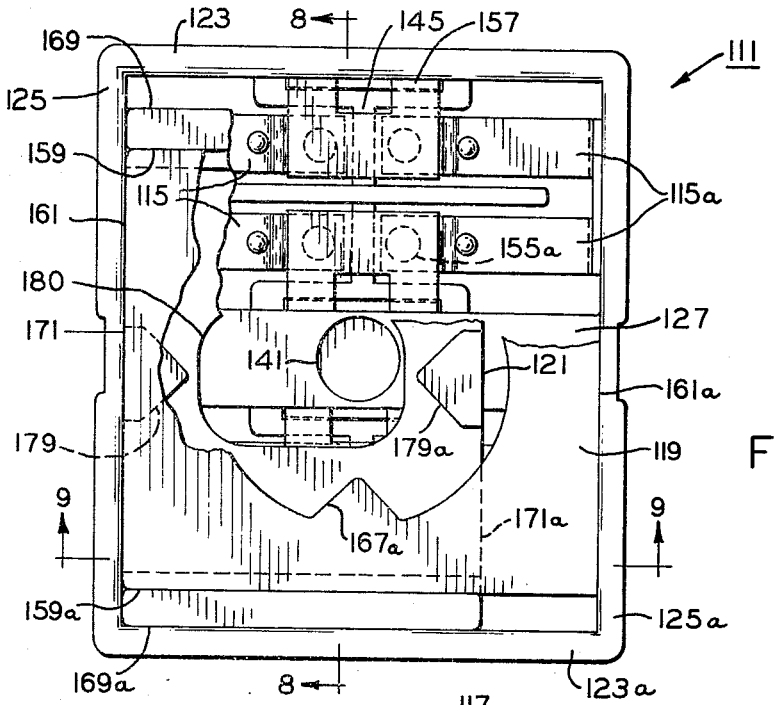
FIG. 7 is a plan view of the casing with the controlling means disposed therein and partially broken away and with the cam operator removed for purposes of drawing clarity.
Figure 8:
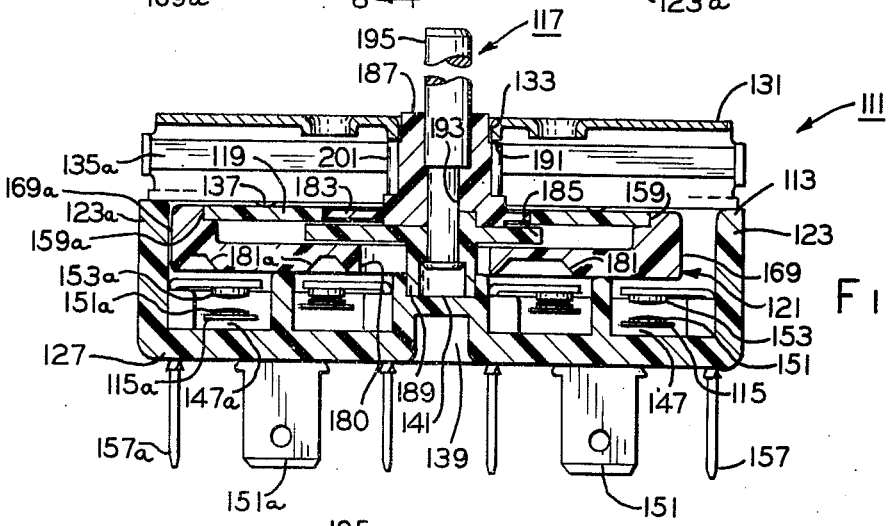
FIGS. 8 and 9 are sectional views taken generally along lines 8—8 and 9—9 in FIG. 7, respectively.

Referring now to the drawings in general, there is illustrated in one form of the invention a method of operating an electrical switch 11, 111 having a casing 13, 113 with a plurality of means, such as resilient switch blades 15, 15*a* and 115, 115*a*, mounted therein and operable generally for respectively completing a circuit (not shown) through the casing (FIGS. 1 and 5). In this operating method, means, such as a cam operator 17, 117, is rotated in casing 13, 113 for respectively driving a pair of means, such as plates 19, 21 and 119, 121, adapted for selectively controlling the operation of the circuit completing means or switch blades 15, 115 (FIGS. 2 and 8). The controlling means or plates 19, 21 and 119, 121 are moved in casing 13, 113 generally linearly with respect to each other in response to the rotating of the driving means or cam operator 17, 117 to effect the selective operation of switch blades 15, 15*a* and 115, 115*a* (FIGS. 1 and 7).

More particularly and with specific reference to FIG. 2, casing 13 of electrical switch 11 is integrally formed of a suitable dielectric material having opposed adjacent pairs or sets of sidewalls 23, 23*a* and 25, 25*a* integrally interconnected with a base wall 27. a sheet of suitable insulation 29 is disposed on the upper or free ends of casing sidewalls 23, 23*a* and 25, 25*a*, and a casing cover 31 of any suitable material having a generally central opening 33 therein is included in casing 13 and mounted over the insulation sheet to the casing sidewalls by suitable means well known to the art (not shown). A pair of indexing springs 35, 35*a* are carried in casing cover 31 on opposite sides of its opening 33 and between the casing cover and insulation sheet 29, as discussed hereinafter.

Figure 3:
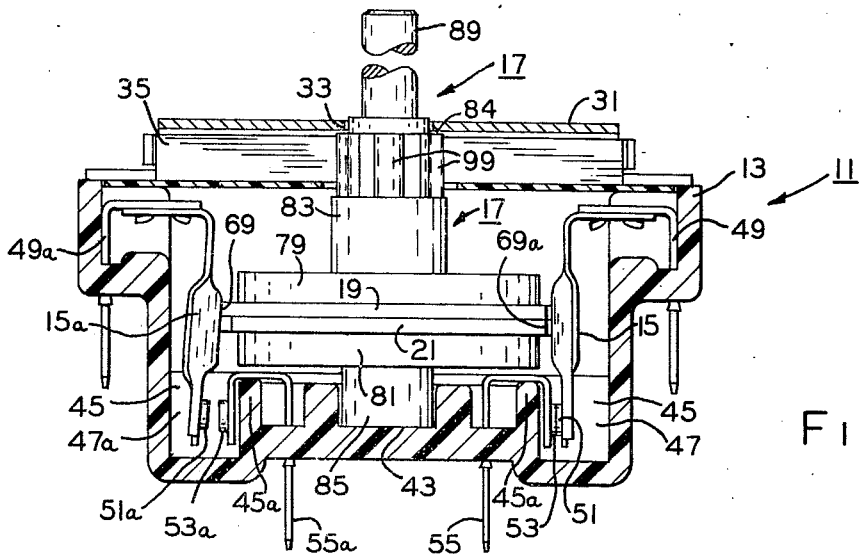
FIG. 3 is a sectional view generally along lines 3—3 of FIG. 1.

A pair of guides or hubs 37, 37*a* are integrally provided on casing sidewalls 25, 25*a*, and a pair of opposite guide surfaces 39, 39*a* and 41, 41*a* are respectively provided on the guides. As shown in FIGS. 2 and 3, casing 13 has a centrally located recess 43 in which cam operator 17 is rotatably received, and a plurality of dividing walls 45, 45*a* are integrally formed on base wall 27 interconnecting with sidewalls 23, 23*a* and 25, 25*a* thereby to form a plurality or opposite sets of separate wells or recesses 47, 47*a* in the casing. A plurality of terminals or terminal sets 49, 49*a* are integrally cast or otherwise fixedly mounted in casing 13 extending therethrough generally adjacent sidewalls 23, 23*a*, and circuit completing means or switch blades 15, 15*a* are mounted to the terminals thereby to provide a pair of opposite switch blade sets. One of the ends of switch blades 15, 15*a* is staked or otherwise fixedly connected by suitable means well known to the art to terminals 49, 49*a*, and the other or free ends of the switch blades extend toward base wall 27 so as to be received within the separate wells 47, 47*a* provided therefor in the base wall. A plurality of movable contacts 51, 51*a* are provided on switch blades 15, 15*a* adjacent the free ends thereof so as to be disposed within separate wells 47, 47*a*, and a plurality of stationary contacts 53, 53*a* are associated with the movable contacts within the separate wells for making and breaking engagement therewith. It may be noted that the disposition of associated ones or sets or movable contacts 51, 51*a* and stationary contacts 53, 53*a* within separate casing wells 47, 47*a* effectively isolates the associated contact sets from each other thereby to generally eliminate arcing therebetween. Stationary contacts 53, 53*a* are mounted to a plurality of terminals or terminal sets 55, 55*a* integrally molded or otherwise fixedly disposed in base wall 27 of casing 13 generally in opposed spaced relation with terminals 49, 49*a*.

Plates 19, 21, which may be formed of suitable dielectric material, are disposed generally in overlaying and sliding relation in casing 13 between switch blades 15, 15*a* and are generally relatively linearly movable with respect to each other, i.e., reciprocally in opposite directions, for controlling the operation of the switch blades, FIG. 1. Plates 19, 21 are generally elongate each including a pair of opposite ends 57, 57*a* and 59, 59*a* which are generally movable toward and away from casing sidewalls 25, 25*a*, and a pair of opposite notches 61, 61*a* and 63, 63*a* are provided in the opposite ends of the plates for sliding and guiding engagement on guide surfaces 39, 39*a* and 41, 41*a* of casing guides 37, 37*a*, respectively. Opposite pairs of side edges 65, 65*a* and 67, 67*a* are provided on plates 19, 21 connecting between opposite ends 57, 57*a* and 59, 59*a* thereof, respectively, and a plurality or sets or predetermined cam configurations 69, 69*a* are respectively provided in side edges 65, 67*a* of plates 19, 21 for selective engagement with associated ones of switch blades 15, 15*a* to effect selective actuation thereof in a predetermined program upon the reciprocal movement of the plates in casing 13, as discussed hereinafter. The specific lands and grooves constituting cam configurations 69, 69*a* are shown herein only for the purpose of disclosure, and it is contemplated that different spacings of the lands and grooves or different types of cam configurations may be utilized within the scope of the invention. It is also contemplated that other cam configurations (not shown) may be provided, if desired, in side edges 65*a*, 67 of plates 19, 21 within the scope of the invention for selective engagement with associated switch blades 15*a*, 15 to also effect the selective actuation thereof in the aforementioned predetermined program. As shown in FIGS. 1 and 3 with plates 19, 21 generally in their at-rest positions, some of cam configurations 69, 69*a* are disposed in camming engagement with associated ones of switch blades 15, 15*a* biasing or displacing them so as to break movable contacts 51, 51*a* thereof from their associated stationary contacts 53, 53*a* to respectively interrupt circuits through casing 13 in a selected program, and others of cam configurations 69, 69*a* are disengaged from associated other ones of switch blades 15, 15*a* thereby to effect the making of movable contacts 51, 51*a* thereof with their associated stationary contacts 53, 53*a* to respectively complete circuits through casing 13. Slots or openings 71, 73, as shown in FIG. 2, are generally centrally provided through plates 19, 21, respectively, for receiving cam operator 17, and a pair of cam followers, such as studs or rivets 75, 77 are predeterminately located adjacent the slots in the plates being staked, riveted or otherwise fixedly connected thereto by suitable means well known to the art. Cam followers 75, 77 extend from plates 19, 21 generally in opposite directions, i.e., toward casing cover 31 and casing base wall 27, respectively, for driven engagement with cam operator 17.

Figure 4:
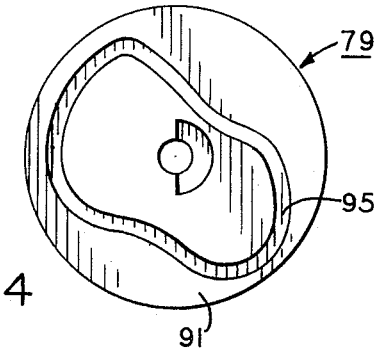
FIGS. 4 and 4A are fragmentary views illustrating the cam configurations of a cam operator for the electrical switch of FIG. 1.
Figure 4A:
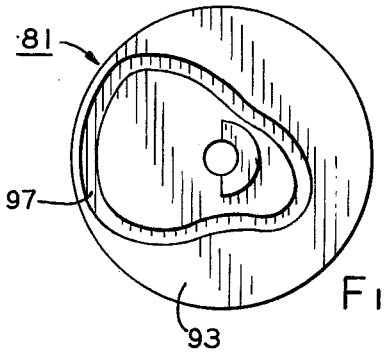

Means, such as cam operator 17, is rotatably mounted in casing 13 for respectively driving plates 19, 21 generally linearly relative to each other to effect the selective operation of switch blades 15, 15*a*, as previously mentioned. Cam operator 17 is generally constituted by upper and lower cams 79, 81 which are predeterminately aligned both rotatively and axially with each other, and plates 19, 21 are slidably and guidably embraced or sandwiched between the cams. Oppositely disposed extensions 83, 85 are integrally provided on cams 79, 81 being respectively rotatably received in opening 33 of casing cover 31 and central recess 43 in casing base wall 27, respectively, and extension 83 is provided with an annular shoulder 84 engaged with the casing cover generally about its opening thereby to maintain cam operator 17 against vertical displacement from within casing 13 and casing cover 31. A stepped bore 87 is provided through aligned cams 79, 81, and a partially flat, stepped operating shaft 89, which is also included in cam operator 17, is fixedly received in the stepped bore by suitable means well known to the art thereby to maintain the cams against displacement from their assembled or predetermined axial and radial or rotative aligned positions. Cams 79, 81, FIGS. 4 and 4A, have a pair of opposed faces 91, 93 on which plates 19, 21 are slidable, and a pair of cam grooves 95, 97 having predetermined cam configurations generally in a continuous or closed loop, are provided in the cam faces. It may be noted that the configurations of cam grooves 95, 97 are different, and at least a part of the configurations of each cam groove is developed to accommodate or correspond to the camming action of each other. The particular configurations of cam grooves 95, 97 are shown only for the purposes of disclosure, and it is contemplated that other configurations for the cam grooves may be utilized within the scope of the invention. Cam grooves 95, 97 are so disposed to receive in driving or camming engagement cam followers 75, 77 which extend from plates 19, 21, and this camming engagement is effective to translate or convert rotary movement of cam operator 17 so as to impart reciprocal or displacement and return linear movement to the plates upon manual rotation of cam operator 17. It may also be noted that the different configurations of cam grooves 95, 97 are effective to impart the generally linear movements to plates 19, 21 at selected instantaneous rates so as to program the selective operation of switch blades 15, 15*a* thereby as discussed hereinafter. Since shaft 89 maintains cams 79, 81 against relative axial and rotative displacement, cam operator 17 and plates 19, 21 may be pre-assembled generally as a unit and then assembled in casing 13 in the positions described above so that rotation of cam operator 17 respectively drives plates 19, 21 generally linearly relative to each other for selectively operating switch blades 15, 15*a* which were, of course, previously disposed in or assembled to the casing. To complete the description of switch 11, a plurality of detents 99 are provided about the upper end of cam extension 83 for cooperating engagement with detent springs 35, 35*a* to maintain cam operator 17 in a selected one of its indexed rotated positions upon the rotation thereof, and an operating knob or handle (not shown) may be received on the portion of shaft 89 exteriorly of casing cover 31 for manually rotating cam operator 17.

OPERATION

With the component parts of electrical switch 11 positioned therein as shown in FIGS. 1–3 and as described above, cam operator 17 may be rotated in either a clockwise or a counter-clockwise direction in response to a manually applied rotative force thereon, and cams 79, 81 are, of course, conjointly rotated therewith. Upon such conjoint rotation of cams 79, 81 cam grooves 95, 97 are moved in camming or driving engagement on cam followers 75, 77 of plates 19, 21, and the following engagement of the cam followers in the cam grooves converts or translates the rotary applied force movement of cam operator 17 into generally linear reciprocating movement of the plates in casing 13 toward and away from sidewalls 25, 25*a* thereof. As previously mentioned, the instantaneous movements so imparted to plates 19, 21 may be of different selected rates throughout the stroke or travel of the plates, and such different selected rates of instantaneous movements are, at least for the most part, dictated by the particular configurations of cam grooves 95, 97. As best seen in FIG. 1, turning or twisting movement of plates 19, 21 generally about cam operator 17 in response to the camming engagement of cam grooves 95, 97 with cam followers 75, 77 is resisted or prevented by the sliding engagement of notches 61, 63 and 61*a*, 63*a* in the plates on opposite guide surfaces 39, 39*a* and 41, 41*a* of casing hubs 37, 37*a*, respectively. Alternatively, the sidewalls of slots 71, 73 in plates 19, 21 could slidably guide on cam operator 17 with only one of notches 61, 61*a* and 63, 63*a* of each plate being slidably and guidably received on its associated guide surfaces 39, 39*a* and 41, 41*a* of casing hubs 37, 37*a* to resist the turning or twisting movement of the plates about cam operator 17.

In response to the rotary-to-linear motion translation effected between cam operator 17 and plates 19, 21, as discussed above, plate 19 is moved or displaced from its at-rest position in casing 13 rightwardly (as best seen in FIG. 2) toward casing sidewall 25*a*, and plate 21 is moved or displaced from its at-rest position in the casing leftwardly in the opposite direction toward casing sidewall 25. Of course, the extent and rate of the relative linear movements of plates 19, 21 in casing 13 is directly related to the extent cam operator 17 is manually rotated and also to the particular configurations of the continuous cam grooves 95, 97 driving on cam followers 75, 77, as previously noted. Upon the respective rightward and leftward movements of plates 19, 21, the plurality of cam configurations 69, 69*a* thereof are cojointly moved generally along switch blades 15, 15*a* to effect the selective operation of associated ones of the switch blades for controlling the actuation thereof in a selected program. In other words, the displacement movement of some of cam configurations 69, 69*a* into camming engagement with associated ones of switch blades 15, 15*a* urges them toward a displaced position breaking the respective movable contacts 51, 51*a* thereof from their associated stationary contacts 53, 53*a* so as to respectively interrupt a circuit through electrical switch 11, and at the same time, the disengagement of other ones of cam configurations 69, 69*a* from associated other ones of switch blades 15, 15*a* permits them to resiliently urge the movable contacts 51, 51*a* thereof into making engagement with their associated stationary contacts 53, 53*a* so as to respectively complete a circuit through electrical switch 11, FIGS. 1 and 3.

Of course, through the camming engagement of cam grooves 95, 97 with cam followers 75, 77, cam operator 17 is generally operable to translate its farther rotation in response to the rotative force applied thereto into linear motion thereby to effect further travel of plates 19, 21 in their generally linear paths causing further selective operation of switch blades 15, 15*a* by cam configurations 69, 69*a* in the selected program, as previously described. As previously mentioned, the configurations of cam grooves 95, 97 may be predetermined to provide various desired relative movements of plates 19, 21 to selectively actuate switch blades 15, 15*a* in their predetermined program, and if desired, the configurations of the cams may be such as to temporarily or intermittently effect a change of reversal of the linear direction in which plates 19, 21 move during their travel or translatory movement. However for the purpose of clarity and simplicity, such reversal in the linear direction of plates 19, 21 during their respective travels or translatory movements are not shown or described herein. When cam operator 17 has been manually rotated through a selected portion of a complete revolution thereof, plates 19, 21 will have been linearly moved through the entire length of their displacement movement or travel, i.e., from their at-rest positions to their fully displaced positions, between casing sidewalls 25, 25*a*. Upon further manual rotation of cam operator 17 to effect a complete revolution thereof, the driving or camming engagement of cam grooves 95, 97 on cam followers 75, 77 of plates 19, 21 reverses the linear movement thereof and returns the plates to their original or at-rest positions in casing 13. Of course, one of plates 19, 21 may attain its fully displaced position prior to the other of the plates, and the linear movement of one of plates 19, 21 to return it towards its at-rest position may be effected prior to the other of the plates. During this return movement or travel of plates 19, 21, cam configurations 69, 69*a* thereof effect the selective operations of switch blades 15, 15*a* in the selected program therefor. It may be noted that the return portions of the continuous loop or cam configuration of cam grooves 95, 97 may be different than the displacement portions thereof; therefore, the instantaneous rates of the return movement of plates 19, 21 may differ from that of the displacement movements of the plate. In this manner, the operation of switch blades 15, 15*a* by cam configurations 69, 69*a* may be preselected or programmed during the displacement and return movements of plates 19, 21.

Referring now to FIGS. 5–9, alternative electrical switch 111 is disclosed meeting at least some of the object or advantageous and salient features set out hereinbefore with respect to the above-described electrical switch 11; however, it may be noted that electrical switch 111 also has other indigenous advantageous and salient features or objects which will be in part apparent and in part pointed out hereinafter.

Figure 9:
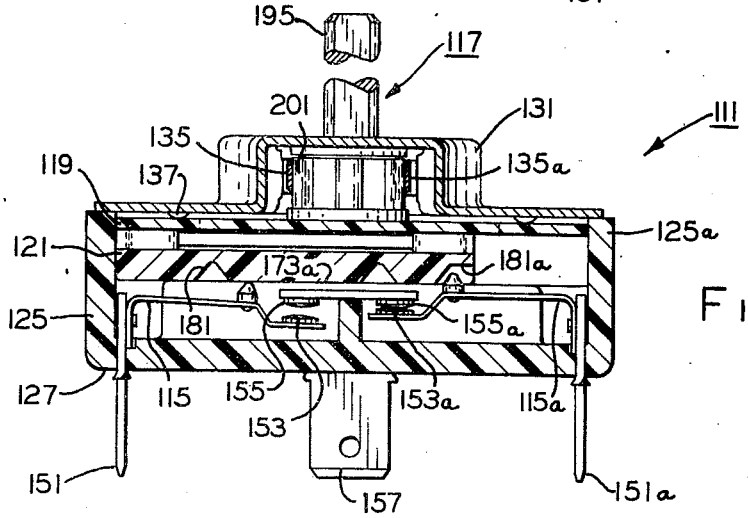

More particularly and with specific reference to FIG. 5, casing 113 of electrical switch 111 is integrally formed of a suitable dielectric material having opposed adjacent pairs or sets of sidewalls 123, 123*a* and 125, 125*a* integrally interconnected with a base wall 127. In FIGS. 8 and 9, casing 113 includes a cover 131 of any suitable material having a central opening 133 therein, and the casing cover overlays sidewalls 123, 123*a* and 125, 125*a* of the casing being releasably attached thereto by suitable means well known to the art (not shown). A pair of indexing springs 135, 135*a*, are carried in casing cover 131 on opposite sides of its opening 133, and a plurality of guide detents 137 are displaced from the casing cover so as to face the interior of casing 113, as discussed hereinafter.

a hug 139, as shown in FIGS. 5 and 8, is centrally located and integrally formed on base wall 127, and a recess 141 is provided in the free or upper end of the hub for positioning or displacement preventing engagement with cam operator 117. A plurality of spaced apart, integral dividing walls 143 are provided on base wall 127 interconnecting between casing sidewalls 125, 125*a*, and a plurality of integral cross-dividing walls 145 are also provided on the base wall extending generally between casing sidewalls 123, 123*a* and hub 139 and intersecting with dividing walls 143. In this manner, dividing walls 143 and cross-dividing walls 145 define a plurality or opposite sets of separate recesses or wells 147, 147*a* within casing 113, and the upper or free ends 149 of dividing walls 143 are generally coplanar thereby to define a guide or supporting surface on which plate 121 is slidably received. A plurality of terminals or terminal sets 151, 151*a* are integrally cast or otherwise fixedly mounted in casing 113 extending therethrough generally adjacent casing sidewalls 125, 125*a*, and circuit completing means or switch blades 115, 115*a* are respectively disposed in casing wells 147 and mounted to the terminals thereby to provide a pair of opposite switch blade sets. One of the ends of switch blades 115, 115*a* is riveted, staked or otherwise fixedly connected by suitable means well known to the art to terminals 151, 151*a*, and the other or free ends of the switch blade generally overlay casing base wall 127 within casing wells 147. A plurality of movable contacts 153, 153*a* are provided on switch blades 115, 115*a* adjacent the free ends thereof, and a plurality of stationary contacts 155, 155*a* are associated with the movable contacts within separate wells 147, 147*a* for making and breaking engagement therewith, respectively. Stationary contacts 155, 155*a* are mounted to a plurality of terminals 157*a* integrally molded or otherwise fixedly disposed in base wall 127 of casing 113 and extending therethrough. Of course, the disposition of stationary contacts 155, 155*a* and switch blades 115, 155*a* with movable contacts 153, 153*a* thereon within separate wells 147, 147*a* in casing 113 electrically isolates each of the associated ones of the stationary and movable contacts from the others thereof which is effective to eliminate arcing therebetween.

Figure 6:
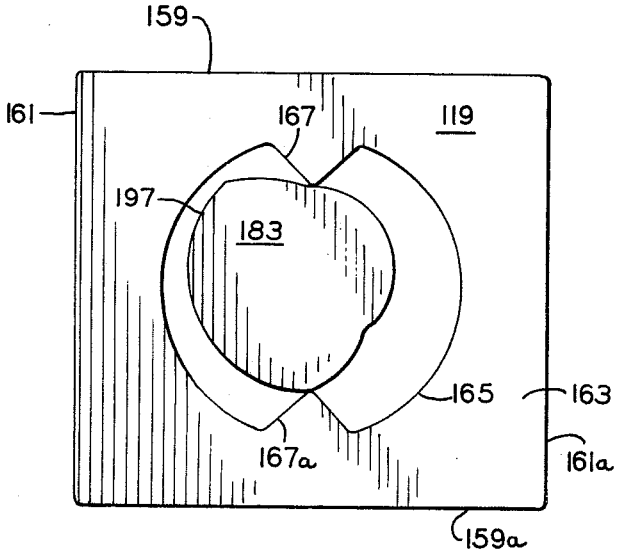
FIGS. 6 and 6A are fragmentary views illustrating the cam configurations of a pair of cams of a cam operator for the electrical switch of FIG. 5 and the driving engagements thereof with a pair of controlling means of the electrical switch.

Plates 119, 121, which preferably are formed from suitable dielectric material, are disposed generally in overlaying and sliding relation with respect to each other in casing 113 and also with respect to switch blades 115, 115*a*, and the plates are generally relatively linearly movable with respect to each other, i.e., generally in normal or perpendicular directions, for controlling the selective operation of the switch blades, as shown in FIGS. 7–9 and discussed in greater detail hereinafter. Referring now to FIG. 6, plate 119 is generally planar having opposite pairs of side edges 159, 159*a* and 161, 161*a* interconnected between opposite faces 163, 163*a*. An opening 165 is provided through plate 119 intersecting opposite faces 163, 163*a* generally centrally thereof for receiving cam operator 117, and a pair of cam followers or generally pointed nibs 167, 167*a* are integrally formed on the plate extending generally in opposed relation toward each other into opening 165.

Figure 6A:
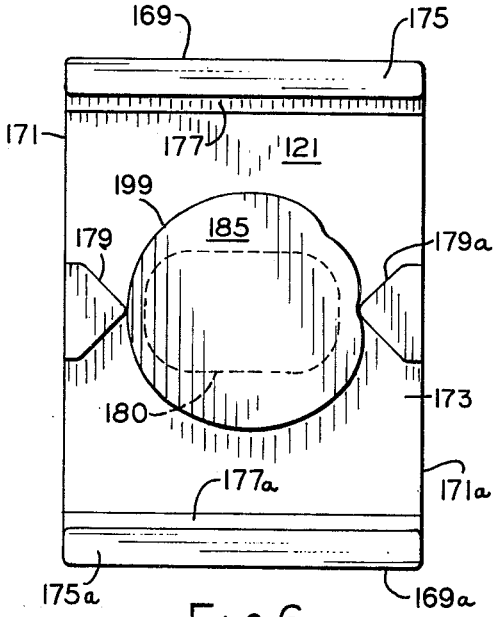

Plate 121 is also generally planar having opposite pair of side edges 169, 169*a* and 171, 171*a* interconnecting between opposite faces 173, 173*a* thereof, FIG. 6A. A pair of opposite abutments 175, 175*a* are integrally formed with side edges 169, 169*a* of plate 121 and extend generally normally with respect to face 173 thereof, and a pair of opposite guide notches or generally L-shaped guide surfaces 177, 177*a* are provided on the abutments extending between side edges 171, 171*a* of the plate so as to provide a slideway for plate 119. Another pair of cam followers or generally pointed nibs 179, 179*a* are integrally formed on plate 121 adjacent side edges 171, 171*a* and extend generally normally from face 173 of the plate, and an opening 180 is provided through the plate intersecting its faces 173, 173*a* through which cam operator 117 extends. Cam followers 179, 179*a* extend generally in opposed relation toward each other and are disposed so as to be generally normal or perpendicular to cam followers 167, 167*a* of plate 119 upon the assembly thereof with plate 121 in casing 113. As shown in FIGS. 8 and 9, a plurality or sets of cam configurations 181, 181*a* are respectively provided in lower face 173*a* of plate 121 for selective engagement with associated ones of witch blades 115, 115*a* to effect selective actuation thereof in a predetermined program upon the linear movements of plates 119, 121 in casing 113, as discussed hereinafter. The specific lands and grooves in lower face 173*a* of plate 121 constituting cam configurations 181, 181*a* are shown herein only for the purpose of disclosure, and it is contemplated that different spacings of the lands and grooves or different types of cam configurations may be utilized within the scope of the invention.

Referring now to FIGS. 7–9, plates 119, 121 are illustrated generally in their at-rest positions in casing 113. In its at-rest position, plate 121 is disposed with its adjacent opposite edges 169*a* , 171 in abutment with adjacent opposite sidewalls 123*a*, 125 of casing 113, and lower face 173*a* of the plate is slidably received in supporting or guiding engagement on guide surfaces 149 of casing divider walls 143. When plate 121 is so seated on guide surface 149, some of cam configurations 181, 181*a* are selectively disposed in camming engagement with associated ones of switch blades 115, 115*a* biasing or displacing them so as to break movable contacts 153, 153*a* from their associated stationary contacts 155, 155*a* to respectively interrupt a circuit through casing 113 of electrical switch 111 in the preselected program, and others of cam configurations 181, 181*a* are disengaged from associated other ones of switch blades 115, 115*a* thereby to effect the making of movable contacts 153, 153*a* thereof with their associated stationary contacts 155, 155*a* to respectively complete a circuit through casing 113 of electrical switch 111. In its at-rest position, plate 119 is disposed with its side edges 161, 161*a* slidably and guidably received on casing sidewalls 125, 125*a*, and the other side edges 159, 159*a* of the plate are slidably and guidably received on guide surfaces 177, 177*a* of plate 121.

Means, such as cam operator 117, is rotatably mounted in casing 113 for respectively driving plates 119, 121 generally linearly with respect to each other to effect the selective operation of switch blades 115, 115*a*, as previously mentioned. As shown in FIG. 8, cam operator 117 is generally constituted by upper and lower cams 183, 185 which are predeterminately aligned both rotatively and axially with each other, and oppositely disposed extensions 187, 189 are integrally formed with cams 183, 185 being respectively rotatably received in opening 133 in casing cover 131 and central recess 141 in casing base wall 127, respectively. Extension 187 is provided with an annular shoulder 191 engaged with casing cover 131 generally about its opening 133 thereby to maintain cam operator 117 against vertical displacement from within casing 113 and casing cover 131, and a stepped bore 193 is provided through aligned cams 183, 185 and their extensions 187, 189. A partially flat, stepped operating shaft 195, which is also included in cam operator 117, is fixedly received in stepped bore 193 by suitable means well known to the art thereby to maintain cams 183, 185 against displacement from their assembled or predetermined axial and radial or rotative aligned positions. Cams 183, 185, as also shown in FIGS. 6 and 6A, are provided with peripheral faces or surfaces 197, 199 each having a predetermined cam configuration. It may be noted that the cam configurations of cam peripheral faces 197, 199 are different, and at least a part of the cam configuration of each cam peripheral face is developed to accommodate or correspond to the camming action of each other. The particular cam configurations of peripheral cam faces 197, 199 are shown only for the purposes of disclosure, and it is contemplated that other cam configurations for the cam peripheral faces may be utilized within the scope of the invention. Cam peripheral faces 197, 199 are so disposed to receive in camming or driving engagement the cam followers 167, 167*a* and 179, 179*a* of plates 119, 121, respectively, and this camming engagement is effective to translate or convert rotary movement of cam operator 117 so as to impart reciprocal or displacement and return linear movement to the plates, i.e., in generally normal or perpendicular directions with respect to each other, upon the manual rotation of cam operator 117. It may also be noted that the different cam configurations of cam peripheral faces 197, 199 are also effective to impart the generally linear movements to plates 119, 121 with respect to each other at selected instantaneous rates so as to program the selective operation of switch blades 115, 115*a*, as discussed hereinafter. Since shaft 195 maintains cams 183, 185 against axial and rotative displacement with respect to each other, cam operator 117 may be preassembled generally as a unit and then assembled or disposed in casing 113 in conjunction with plates 119, 121, as shown in FIG. 8 and as described above, so that rotation of the cam operator respectively drives the plates generally linearly with respect to each other for selectively operating switch blades 115, 115*a* which were, of course, previously disposed in or assembled to the casing. To complete the description of electrical switch 111, a plurality of indexing detents or adjacent grooves 201 are provided about the upper end of cam extension 187 generally adjacent opening 133 in casing cover 131 for cooperating engagement with detent springs 135, 135*a* to maintain cam operator 117 in a selected one of its indexed rotated positions upon the rotation thereof, and an operating knob or handle (not shown) may be received on the portion of shaft 195 exteriorly of casing cover 131 for manually rotating cam operator 117.

With the component parts of electrical switch 111 disposed therein as shown in FIGS. 5–9 and as described above, cam operator 117 may be rotated in either a clockwise or counter-clockwise direction in response to a manually applied rotative force thereon, and cams 183, 185 are, of course, conjointly rotated therewith. Upon such conjoint rotation of cams 183, 185, cam peripheral faces are moved in camming or driving engagement on cam followers 167, 167*a* and 179, 179*a* of plates 119, 121, and the following engagement of the cam followers translates or converts the rotary applied force movement of cam operator 117 into the generally linear movement of the plates with respect to each other in casing 113. As previously noted, the instantaneous movements so imparted to plates 119, 121 may be of different selected rates throughout the stroke or travel of the plates, and such different selected rates of instantaneous movements are, at least for the most part, dictated by the particular cam configurations of cam peripheral faces 197, 199. It may also be noted that the generally linear movements of plates 119, 121 with respect to each other in casing 113 effects generally universal movement of plate 121 with respect to switch blades 115, 115*a*, and such universal movement may be programmed by the predetermined cam configurations of cam peripheral faces 197, 199 to effect the programmed or selective operation of the switch blades, as described below. As best seen in FIGS. 6 and 7, turning or twisting movement of plates 119, 121 generally about cam operator 117 in response to the camming engagement of cams 183, 185 with cam followers 167, 167*a* and 179, 179*a* is resisted or prevented by the sliding and guiding engagement of side edges 161, 161*a* of plate 119 on sidewalls 125, 125*a* of casing 113 and by the sliding and guiding engagement of side edges 159, 159*a* of plate 119 on guide surfaces 177, 177*a* of plate 121.

In response to the rotary-to-linear motion translation effected between cam operator 117 and plates 119, 121, as discussed above, plate 119 is initially or displaced from its at-rest position in casing 113 vertically on sidewalls 125, 125*a* thereof (as best seen in FIG. 7) toward casing sidewall 123, and at the same time, plate 121 is initially moved or displaced from its at-rest position in casing 113 generally horizontally with respect to plate 119 on side edges 159, 159*a* thereof. It may be noted that with respect to casing 113, plate 121 is movable both with plate 119 generally vertically and also relative to plate 119 generally horizontally thereof in response to the camming action of cams 183, 185 thereon, and in this manner, the aforementioned programmed universal movement of plate 121 is effected. Of course, the extent and rate of the relative linear movements of plates 119, 121 with respect to each other in casing 113 is directly related to the extent cam operator 117 is manually rotated and also to be particular cam configurations of cam peripheral faces 197, 199 driving on cam followers 167, 167*a* and 179. 179*a*, respectively, as previously mentioned. Upon such movement of plates 119, 121 in casing 113, the plurality of cam configurations 181, 181*a* on lower face 173*a* of plate 121 are moved generally along and/or across or between the sets of switch blades 115, 115*a* to effect the selective operation of associated ones of the switch blades for controlling the actuation thereof in the established program. In other words, the displacement movement of some of cam configurations 181, 181*a* into camming engagement with associated ones of switch blades 115, 115*a* urges them toward displaced positions breaking the respective movable contacts 153, 153*a* thereof from their associated stationary contacts 155, 155*a* so as to respectively interrupt a circuit through electrical switch 111, and at the same time, the disengagement of other ones of cam configurations 181, 181*a* from associated other ones of switch blades 115, 115*a* permits them to resiliently urge the movable contacts 153, 153*a* thereof into making engagement with their associated stationary contacts 155, 155*a* so as to respectively complete a circuit through electrical switch 111, FIGS. 8 and 9.

Of course, through the camming engagement of cams 183, 185 with cam followers 167, 167*a* and 179, 179*a* of plates 119, 121, cam operator 117 is generally operable to translate its farther rotation in response to the rotative force applied thereto in linear motion thereby to effect further travel of the plates in their generally linear paths with respect to each other causing farther selective operation of switch blades 115, 115*a* by cam configurations 181, 181*a* in face 173*a* of plate 121 in the established program, as previously described. As previously mentioned, the configurations of cam faces 197, 199 of cams 183, 185 may be predetermined to provide various desired relative movements of plates 119, 121 to selectively actuate switch blades 115, 115*a* in their predetermined program, and, if desired, the configurations of the cam faces may be such as to temporarily or intermittently effect a change or reversal of the linear direction in which plates 119, 121 move during their travel or translatory movement. However, for the purpose of clarity and simplicity, such reversal in the linear direction of plates 119, 121 during their respective travels or translatory movements are not shown or described herein. When cam operator 117 has been manually rotated through a selected portion of a complete revolution thereof, plates 119, 121 will have been linearly moved through the entire length of their displacement movement or travel, i.e., from their at-rest positions to their fully displaced positions. Upon further manual rotation of cam operator 117 to effect a complete revolution thereof, the camming engagement of cams 183, 185 with cam followers 167, 167*a* and 179, 179*a* of plates 119, 121 reverses their generally linear movements with respect to each other and returns the plates to their original or at-rest positions in casing 113. Of course, one of plates 119, 121 may attain its fully displaced position prior to the other of the plates, and the return movement of one of plates 119, 121 toward its at-rest position may be effected prior to that of the other of the plates. During this return movement of travel of plates 119, 121, cam configurations 181, 181*a* in plate 121 further effects the selective operations of switch blades 115, 115*a* in the established program therefor. It may be noted that the return portions of cam peripheral faces 197, 199 may be different than the displacement portion thereof; therefore, the instantaneous rates of the return movements of plates 119, 121 may differ from that of the displacement movements of the plates. Likewise, it may be noted that the return travel of plates 119, 121 with respect to switch blades 115, 115*a* may differ from the displacement travel of the plates with respect to the switch blades. In this manner, the operation of switch blades 115, 115*a* by cam configurations 181, 181*a* in plate 121 may be preselected or established during the displacement and return movements of plates 119, 121.

Referring now to the drawings in general and recapitulating, at least in part, with respect to the foregoing discussion, there is provided in one form of the invention an electrical switch 11, 111 with a casing 13, 113 having a plurality of means, such as switch blades 15, 15*a* and 115, 115*a*, selectively operable for respectively completing a circuit (not shown) through the casing (FIGS. 2 and 7, 8). A pair of means, such as plates 19, 21 and 119, 121, are relatively movable generally linearly with respect to each other in casing 13, 113 for controlling the selective operation of the circuit completing means or switch blades 15, 15*a* and 115, 115*a*, and means, such as a cam operator 17, 117, is rotatably mounted in the casing for driving the controlling means or plates 19, 21 and 119, 121 generally linearly relative to each other or with respect to each other to effect the selective operation of the switch blades.

It is now apparent that novel electrical switches 11, 111 and novel method of operating an electrical switch have been presented meeting the objects and advantageous features set out hereinbefore, as well as others. Further, it is contemplated that changes may be made by those having ordinary skill in the art as to the precise arrangements, shapes, details and connections of the component parts of electrical switches 11, 111, and that variances may be made as to the precise steps in which the operating method is practiced without departing from the spirit of the invention or the scope thereof as set out in the claims which follow.

What I claim as new and desire to secure by Letters Patent of the United States is:

1. An electrical switch comprising a casing having a plurality of means selectively operable for respectively completing a circuit through said casing, a pair of means disposed generally in overlaying relation in said casing and movable with respect to each other in a predetermined program for controlling the operation of said circuit completing means, and means rotatably mounted in said casing for driving each of said controlling means in the predetermined program with respect to each other so as to effect the selective operation of said circuit completing means.

2. An electrical switch as set forth in claim 1 wherein said driving means includes means for respectively camming said controlling means to drive them in the predetermined program with respect to each other.

3. An electrical switch as set forth in claim 2 wherein said controlling means respectively include means for following engagement with said camming means.

4. An electrical switch as set forth in claim 1 wherein said casing includes means for generally isolating at least in part each of said circuit completing means from the others thereof.

5. An electrical switch as set forth in claim 1 wherein said controlling means and said driving means respectively include means for camming engagement so as to effect the driving of said controlling means upon the rotation of said driving means.

6. An electrical switch as set forth in claim 1 wherein said circuit completing means are disposed in said casing generally in opposed row formations, and means on each of said controlling means for actuating said circuit completing means in at least one of said opposed row formations thereof so as to effect the selective operation of said circuit completing means.

7. An electrical switch as set forth in claim 1 further comprising a pair of means within said casing and respectively engaged with said controlling means for guiding the movements of said controlling means generally linearly with respect to each other.

8. An electrical switch as set forth in claim 1 wherein said controlling means include a pair of plates disposed in the overlaying relation in said casing, at least one pair of opposite edges on said plates, and means respectively on said at least one opposite edge pair for actuating said circuit completing means so as to effect the selective thereof.

9. An electrical switch as set forth in claim 1 further comprising means in said casing for indexing engagement with said driving meas upon the rotation thereof.

10. An electrical switch as set forth in claim 1 wherein at least one of said controlling means include means for actuating said circuit completing means so as to effect the selective operation thereof.

11. An electrical switch as set forth in claim 1 further comprising means on said casing for guiding engagement with at least one of said controlling means.

12. An electrical switch as set forth in claim 11 wherein said at least one controlling means includes other means for guiding engagement with the other of said controlling means.

13. An electical switch as set forth in claim 12 wherein one of said at least one controlling means and said other controlling means include means for actuating said circuit completing means so as to effect the selective operation thereof.

14. An electrical switcch as set forth in claim 1 wherein said circuit controlling means include a plurality of switch blades disposed in said casing and selectively operable between circuit making and breaking positions.

15. An electrical switch comprising a casing having a pair of sets of means selectively operable for respectively completing a circuit through said casing, a pair of means disposed in overlaying relation in said casing and predeterminately movable in different directions with respect to each other generally along said sets of said circuit controlling means for controlling the selective operation of said circuit completing means, and means mounted in said casing for rotatable movement in response to an applied force thereon including means engaged with said controllingenas for camming said controlling means to effect the predetermined movement thereof with respect to each other generally in the different directions so as to effect the selective operation of said circuit completing means in said sets thereof.

16. An electrical switch as set forth in claim 15 wherein said camming means include a pair of cam configurations, and means on said controlling means for following engagement with said cam configurations, respectively.

17. An electrical switch as set forth in claim 15 wherein said controlling means respectively include means for actuating said circuit completing means in at least one of said sets so as to effect the selective operation of said circuit completing means.

18. An electrical switch as set forth inclaim 15 wherein one of said controlling means includes means for actuating said circuit completing means so as to effect the selective operation thereof.

19. An electrical switch as set forth in claim 15 wherein said controlling means include a pair of plates, one of said plates being slidably movable in generally opposite linear directions in said casing, means on said one plate for sliding and guiding engagement with the other of said plates, said other plate being conjointly movable with said one plate in said casing and movable on said sliding means in a direction different than the opposite linear directions, and means on said other plate for actuating said circuit completing means so as to effect the selective operation thereof.

20. An electical switch comprising a casing, a pair of sets of means selectively operable for respectively completing a circuit through said casing with said sets of circuit completing means being disposed generally in opposite row formations in said casings, a pair of means disposed in overlaying and a sliding relation in said casing between said sets of said circuit completing means and movable generally linearly in opposite directions with respect to each other for controlling the selective operation of said circuit completing means, and means mounted i said casing and rotatably movable in response to an applied force for driving each of said controlling means generally linearly in the opposite directions to effect the selective operation of said circuit completing in said sets thereof, respectively.

21. An electrical switch as set forth in claim 20 wherein said casing includes a pair of means engaged with said controlling means for guiding them generally linearly in the opposite directions.

22. An electrical switch as set forth in claim 20 wherein said controlling means respectively include a plurality of means for actuating an associated one of said circuit completing means in said sets thereof to effect the selective operation thereof upon the movement of said controlling means in their opposite directions.

23. An electrical switch as set forth in claim 20 wherein said controlling means include a pair of opposite edges extending generally along said sets of said circuit completing means, and a plurality of cam configurations in each of said opposite edges for engagement with an associated one of said circuit completing means so as to effect its selective operation upon the movement of said controlling means generally linearly in the opposite directions.

24. An electrical switch comprising a casing having a first and second pair of opposed sidewalls interconnected by a base wall, a first and second pair of opposite guide surfaces in the casing adjacent the first sidewall pair of and between the second sidewall pair, respectively, first and second sets of resilient switch blades respectively disposed generally along the second sidewall pair, one of the ends of the switch blades in the first and second switch blade sets being connected to the second sidewall pair and the free ends of the switch blades being disposed adjacent the base wall, a movable contact on each of the switch blades adjacent the free end thereof, a stationary contact assoicated with each of the movable contacts for making and breaking engagement therewith and mounted to the base wall, a plurality of dividing walls integral with at least the base wall for generally isolating each one of the associated stationary contacts and movable contacts from the others thereof, first and second plates reciprocally movable in the casing between the first and second switch blade sets generally toward and away from the first sidewall pair, the first and second plates including first and second pairs of opposite ends having first and second pairs of opposite notches therein engaged with the first and second guide surface pairs, a first and second side edge on the first and second plates between the first and second pairs of opposite ends and extending generally along the first and second switch blade sets, first and second sets of cam configurations in the first side edge of the first plate and the second side edge of the second plate for selectively actuating each of the switch blades in the first and second blade sets upon the reciprocal movement of the first and second plates, and first and second oppositely extending cam followers on the first and second plates, a shaft rotatably mounted to the casing and extending through the first and second plates, first and second cams on the shaft for conjoint rotation therewith and disposed adjacent the first and second plates, and first and second cam grooves in the first and second cams in which the first and second cam followers are received, the first and second cams and the shaft being conjointly rotatably in response to a rotative applied force thereon to drive the first and second cam followers in the first and second cam grooves and reciprocally move the first and second plates to selectively engage the first and second cam configurations thereof with the switch blades of the first and second switch blade sets so as to effect their actuation.

25. An electrical switch comprising a casing, a plurality of means disposed in said casing and each selectively operable for respectively completing a circuit through said casing, means movable in said casing for controlling the operation of said circuit completing means, means disposed in overlaying relation with respect to said controlling means for guiding said controlling means and relatively movable with respect to said controlling means in said casing, and means rotatable in said casing in response to an applied force for respectively driving both said controlling means and said guiding means to effect the selective operation of said circuit completing means.

26. An electrical switch as set forth in claim 25 wherein said driving means includes a pair of means respectively engaged with said guiding means and said controlling means for effecting the relative movements of said guiding means and said controlling means with respect to each other in the casing.

27. An electrical switch as set forth in claim 25 wherein said controlling means includes a plurality of means for respectively actuating an associated one of said circuit completing means to effect the selective operation thereof upon the driven movement of said controlling means and said guiding means.

28. An electrical switch as set forth in claim 25 wherein said controlling means is disposed in said casing generally in overlaying relation with respect to said circuit completing means, and a plurality of cam configurations on said controlling means for actuating engagement with associated ones of said circuit completing means to effect the selective operation thereof upon the driven movement of said controlling means and said guiding means.

29. An electrical switch as set forth in claim 25 wherein said driving means includes a pair of cams repectively drivingly engaged with said controlling means and said guiding means for predeterminately moveing them upon the applied force rotation of said driving means so that said controlling means effects the selective operation of said circuit completing means.

30. An electrical switch as set forth in claim 29 wherein each of said controlling means and said guiding means respectively include a pair of means for following engagement with said cams.

31. An electrical switch comprising a casing having a first and second pair of opposed sidewalls interconnected by a base wall, a first and second set of resilient switch blades, one of the ends of the switch blades in the first and second switch blade sets being respectively mounted generally along the first sidewall pair and the free ends of the switch blades extending generally adjacent the base wall, a movable contact on each of the switch blades adjacent the free ends thereof, a stationary contract assoicated with each of the movable contacts for making and breaking engagement therewith and mounted to the base wall, a plurality of dividing walls integral with at least the base wall for generally isolating each one of the associated stationary contacts and the movable contacts from the others thereof, a first plate having a first and second pair of opposite side edges, the first side edge pair being respectively slidable on the first sidewall pair of the casing to effect generally linear reciporcal movement of the first plate in the casing, a second plate disposed in the casing generally between the first plate and the resilient switch blades and including a pair of opposed abutments, the second side edge pair of the first plate being slidably received on the opposed abutments to effect generally linear reciprocal movement of the second plate with respect to the first plate in a direction generally normal to that ot the first plate, a plurality of cam configurations on the second plate for selectively actuating each of the switch blades in the first and second switch blade sets upon the respective movements on the first and second plates, a first and second pair of generally oppositely disposed cam followers on the first and second plates and extending generally normally with respect to each other, a pair of cams mounted in the casing for conjoint rotation and each having a face in a predetermined configuration for respective driving engagement with the first and second cam follower pairs, the cams being conjointly rotatably movable in response to a rotative force applied thereto to drive their faces on the first and second cam follower pairs and reciprocally move the first and second plates in their respective generally normal linear directions with respect to each other in the casing to selectively engage the cam configurations on the second plate with the associated switch blades of the first and second switch blade sets to effect their selective actuation.

32. A method of operating an electrical switch having a casing, a plurality of means mounted in the casing and selectively operable for respectively completing a circuit through the switch, and a pair of means disposed in overlaying relation in the casing for controlling the selective operation of the circuit completing means, the method comprising the steps of:

a. rotating means in the casing for respectively driving each of the controlling means in a predetermined program with respect to each other; and b. moving the controlling means in the casing through the predetermined program generally linearly with respect to each other in response to the rotating of the driving means so as to effect the selective operation of the circuit completing means.

33. The method as set forth in flaim 32 wherein the moving step includes sliding one of the controlling means on the casing so as to effect the linear movement thereof generally in one direction and guiding on the one controlling means the other of the controlling means so that its linear movement is in another direction generally normal to that of the one controlling means.

34. The method as set forth in claim 32 wherein the moving step includes engaging a plurality of cam configurations on one of the controlling means with associated ones of the circuit completing means so as to effect the selective operation thereof.

35. The method as set forth in claim 32 wherein the moving step includes engaging a plurality of cam configurations on each of the controlling means with associated ones of the circuit completing means so as to effect the selective operation thereof.

36. The method as set forth in claim 32 wherein the driving means includes a pair of cam configurations with the controlling means being disposed in following engagement therewith respectively, and wherein the rotating step includes driving the cam configurations so as to move the controlling means through the predetermined program thereof in the moving step, respectively.

37. An electrical switch comprising a casing, a plurality of stationary contacts mounted in the casing, a plurality of resilient switch blades mounted in the casing and each having a movable contact for making and breaking engagement with the stationary contacts, respectively, the switch blades being adapted for selective operation to effect the making and breaking engagement of the movable contacts with the stationary contacts, a pair of plates disposed in overlaying and sliding relation and relatively movable generally linearly with respect to each other within the casing for controlling the selective operation of the switch blades, and a cap operation rotatably mounted in the casing including a pair of cam means drivingly engaged with the plates for translating rotary movement of the cam operator in response to an applied force thereon into the generally linear movement of the plates with respect to each other so as to effect the selective operation of the switch blades.

* * * * *

UNITED STATES PATENT OFFICE

CERTIFICATE OF CORRECTION

Patent No. 4,012,606 Dated March 15, 1977

Inventor(s) Philip Hutt

It is certified that error appears in the above-identified patent and that said Letters Patent are hereby corrected as shown below:

Column 14, Claim 8, line 7, after "selective" insert - operation
Column 14, Claim 14, line 1, delete"switcch" and insert -switch -
Column 15, line 5, delete "controllingenas" and insert - controlling means -
Column 15, Claim 18, line 1,delete "inclaim" and insert - in claim -
Column 15, Claim 20, line 6, delete "and a sliding" and insert - and sliding -
Column 15, Claim 20, line 11, delete "mounted i said" and insert - mounted in said -
Column 16, Claim 24, line 5, delete "pair of and" and insert - pair and -
Column 16, Claim 24, line 32, delete "second blade" and insert - second switch blade -
Column 17, Claim 29, line 3, delete "repectively" and insert - respectively -
Column 17, Claim 29, line 5, delete "moveing" and insert - moving -
Column 17, Claim 31, line 10, delete "contract assoicated" and insert - contact associated -

UNITED STATES PATENT OFFICE

CERTIFICATE OF CORRECTION

Patent No. 4,012,606 Dated March 15, 1977

Inventor(s) Philip Hutt

It is certified that error appears in the above-identified patent and that said Letters Patent are hereby corrected as shown below:

Column 17, Claim 31, line 19, delete "reciporcal" and insert - reciprocal -
Column 17, Claim 31, line 27, delete "to that ot" and insert - to that of -
Column 18, Claim 33, line 1, delete "flaim" and insert - claim -
Column 18, Claim 37, line 13, delete "cap operation" and insert - cam operator -

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*